US012662882B2

(12) United States Patent
Pendleton

(10) Patent No.: US 12,662,882 B2
(45) Date of Patent: Jun. 23, 2026

(54) METHOD AND APPARATUS FOR IDENTIFYING A BAD MILL TRACK, AND BOREHOLE SYSTEM

(71) Applicant: Baker Hughes Oilfield Operations LLC, Houston, TX (US)

(72) Inventor: Bryan Pendleton, Cypress, TX (US)

(73) Assignee: Baker Hughes Holding LLC, Houston, TX (US)

( * ) Notice: Subject to any disclaimer, the term of this patent is extended or adjusted under 35 U.S.C. 154(b) by 0 days.

(21) Appl. No.: 18/782,717

(22) Filed: Jul. 24, 2024

(65) Prior Publication Data

US 2026/0028882 A1 Jan. 29, 2026

(51) Int. Cl.
*E21B 47/11* (2012.01)
*E21B 7/06* (2006.01)

(52) U.S. Cl.
CPC ..... *E21B 7/061* (2013.01); *E21B 47/11* (2020.05)

(58) Field of Classification Search
CPC ..... E21B 7/061; E21B 41/0035; E21B 27/00; E21B 29/06
See application file for complete search history.

(56) References Cited

U.S. PATENT DOCUMENTS 6,568,480 B2 * 5/2003 Dewey ..... E21B 23/01 166/117.6
7,575,050 B2 * 8/2009 Dale ..... E21B 7/061 175/81
7,726,401 B2 * 6/2010 Parlin ..... E21B 7/06 166/313
8,201,625 B2 * 6/2012 Almaguer ..... E21B 7/061 166/255.2
8,376,066 B2 * 2/2013 Steele ..... E21B 41/0035 166/313

(Continued)

FOREIGN PATENT DOCUMENTS

WO WO-2004046499 A1 * 6/2004 ..... E21B 29/06

OTHER PUBLICATIONS

Khmelnitskiy, et al,. 2022. "Fluorescent Based Tracers for Oil and Gas Downhole Applications: Between Conventional and Innovative Approaches" Engineering Proceedings 19, No. 1: 12. https://doi.org/10.3390/ECP2022-12670; 7 pages.

(Continued)

*Primary Examiner* — Aaron L Lembo
(74) *Attorney, Agent, or Firm* — Baker Hughes Company

(57) ABSTRACT

A method for identifying a bad mill track, including running a whipstock assembly, including a whipstock, an anchor attached to the whipstock and a debris management device attached to the whipstock, the device including a tracer, to a kick-off point in a borehole, running a mill along the whipstock, and monitoring a cuttings stream for presence of the tracer. A whipstock assembly including a whipstock, an anchor attached to the whipstock, a debris management device attached to the anchor, the device inhibiting the migration of debris from a mill during use from migrating downhole of the anchor, and a tracer disposed in contact with the debris management device, the tracer configured for release from the device in the event the device is damaged. A borehole system, including a borehole in a subsurface formation, a string in the borehole, and a whipstock assembly disposed within or part of the string.

10 Claims, 4 Drawing Sheets

(56) References Cited

U.S. PATENT DOCUMENTS

| | | | | |
|---|---|---|---|---|
| 9,010,426 | B2 * | 4/2015 | Saurer | E21B 7/064 166/298 |
| 9,416,638 | B2 * | 8/2016 | Zhou | E21B 7/061 |
| 9,551,192 | B2 * | 1/2017 | Deen | E21B 12/02 |
| 10,683,740 | B2 * | 6/2020 | Randall | E21B 43/267 |
| 11,408,277 | B2 * | 8/2022 | Guzman | E21B 23/01 |
| 12,000,226 | B2 * | 6/2024 | Maribu | E21B 29/12 |
| 2008/0296029 | A1 * | 12/2008 | Ortiz | E21B 41/0042 166/117.6 |

OTHER PUBLICATIONS

Nightsea; Bringing Fluorescence to Light: Oilfield Geology and Fluorescence—NIGHTSEA; Retrieved from the internet: Jun. 10, 2024; 10 pages.

* cited by examiner

METHOD AND APPARATUS FOR IDENTIFYING A BAD MILL TRACK, AND BOREHOLE SYSTEM

BACKGROUND

In the resource recovery and fluid sequestration industries there is often need to mill a side track from a main bore to create a multilateral borehole system. Commonly, whipstocks are anchored in a selected position (kick off point) in the main bore and a mill is directed along the whipstock to mill a window in the main bore casing and exit the casing in that location. Unfortunately, the mill does not always complete the window and proceed into the formation but sometimes can take a bad track that does not go where intended by milling into the whipstock diverter face more significantly than intended and therefore not exiting the casing where planned. It is difficult to recognize a bad track until significant milling has been done beyond the point where the track went bad, costing time and resources to correct. The art would welcome greater efficiencies.

SUMMARY

An embodiment of a method for identifying a bad mill track, including running a whipstock assembly, including a whipstock, an anchor attached to the whipstock and a debris management device attached to the whipstock, the device including a tracer, to a kick-off point in a borehole, running a mill along the whipstock and monitoring a cuttings stream for presence of the tracer.

An embodiment of a whipstock assembly including a whipstock, an anchor attached to the whipstock, a debris management device attached to the anchor, the device inhibiting the migration of debris from a mill during use from migrating downhole of the anchor, and a tracer disposed in contact with the debris management device, the tracer configured for release from the device in the event the device is damaged.

An embodiment of a borehole system, including a borehole in a subsurface formation, a string in the borehole, and a whipstock assembly disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
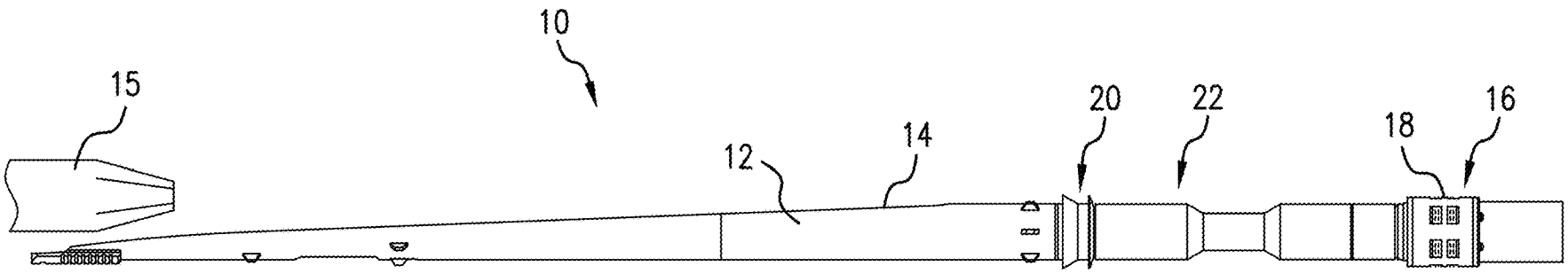
FIG. 1 is a side view of a whipstock assembly having an anchor and debris management device as disclosed herein.
Figure 2:
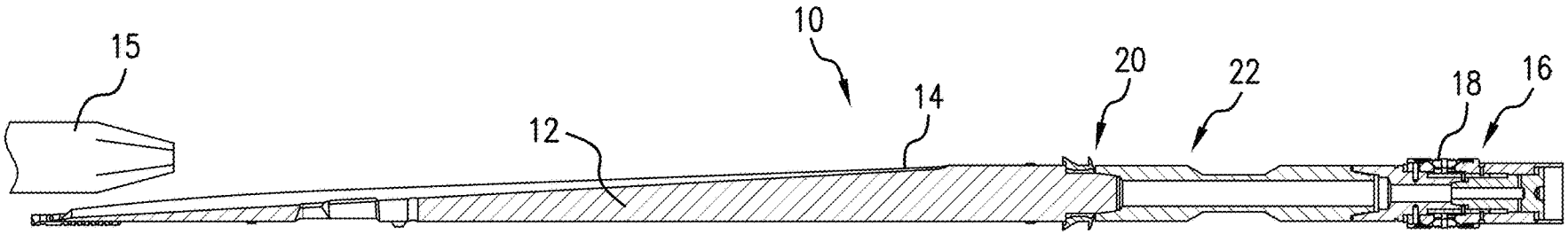
FIG. 2 is a cross sectional view of the assembly illustrated in FIG. 1.
Figure 3:
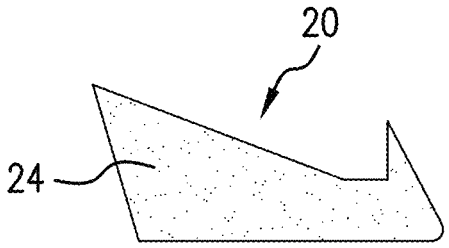
FIG. 3 is a cross sectional illustration of the debris management device with solid or liquid droplet tracer distributed therein.
Figure 4:
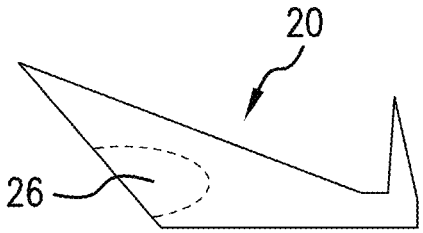
FIG. 4 is a cross sectional illustration of the debris management device with a recess therein for solid or liquid tracer.

Referring to FIGS. 1 and 2, a whipstock assembly 10 is illustrated. Assembly 10 includes a whipstock 12, a diverter face 14, an anchor 16 having a slip 18 and a debris management device 20. The debris management device retains a function ex of prior art debris management devices in that it is located near a downhole end 22 of the whipstock 12 so that debris created by a mill 15 that will be run into contact with the diverter face 14 (run in the hole with the assembly or afterward) will be caught rather than dropped. In this case however, the device 20 also includes in its makeup a tracer 24 that will be released into borehole circulation fluids only in the event the mill makes contact with the device 20 and mills the device 20 (see FIGS. 3-5). This could only happen if the mill does not exit the casing as planned but instead follows a bad track and hits the device 20. In such conditions, the cuttings from device 20 will include tracer 24 mixed in with cuttings of the material of the device itself. These cuttings will all be transported to surface with fluid circulation and may be examined at surface. Surface examination of cuttings is continuous or periodic but evidence of the tracer in those cuttings is cause for concern about the mill taking a bad track. Diligent examination parameters will result in very rapid detection of a bad track and facilitates remedial action with the least additional cost or delay.

Figure 5:
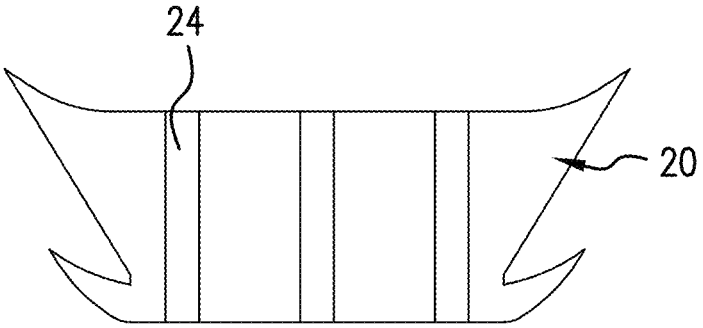
FIG. 5 is a cross sectional illustration of the debris management device with portions thereof created from the tracer material.

The tracer 24 may be solid in nature, in which case it may be particulate or may be a portion of the device 20. Alternatively, the tracer 24 may be liquid or gel in nature and may be distributed throughout device 20 or may be housed in recesses 26 of the device 20. Whether the former or the latter, the tracer 24 may be distributed in the material of device 20, which may be a polymer or soft metal material, or may be disposed in tracer recesses 26 within device 20. To enhance understanding, reference is made to FIG. 3 wherein a cross-sectional illustration of device 20 with solid particulate or liquid droplet tracer 24 is distributed therein. Alternatively, with reference to FIG. 4, an embodiment where the device 20 includes a recess 26 is illustrated. Recesses 26 may simply be hollows in device 20 that are dimensioned and configured to receive the tracer 24, in solid or liquid form, and are either open to the environment or closed to the environment by the material of the device 20. Yet another alternative is illustrated in FIG. 5 wherein a portion of the device itself is formed from tracer 24 material, i.e. some of the device 20 when being formed is of a different material that has tracer properties. It is also contemplated that the entire device 20 be formed from a material that includes tracer properties. It is to be understood that combinations of the types of tracer and configurations are contemplated. In each case, milling of the device 20 will cause a release of the tracer 24. Since milling of the device 20 is not intended, the release of tracer indicates a problem with the track of the mill 15 very quickly through the examination of cuttings.

Tracers contemplated for device 20 include, plastics, rubbers, polymers, monomers, metals, etc. and may be fluorescent materials, brightly colored materials, phosphorescent materials, radioactive materials, and other materials that provide for increased sensorial and/or visual perceptibility at a remote examination location such as at the surface. It is to be appreciated that the application of UV light or black light is contemplated at the examination location to enhance detectability of the tracer material.

Figure 6:
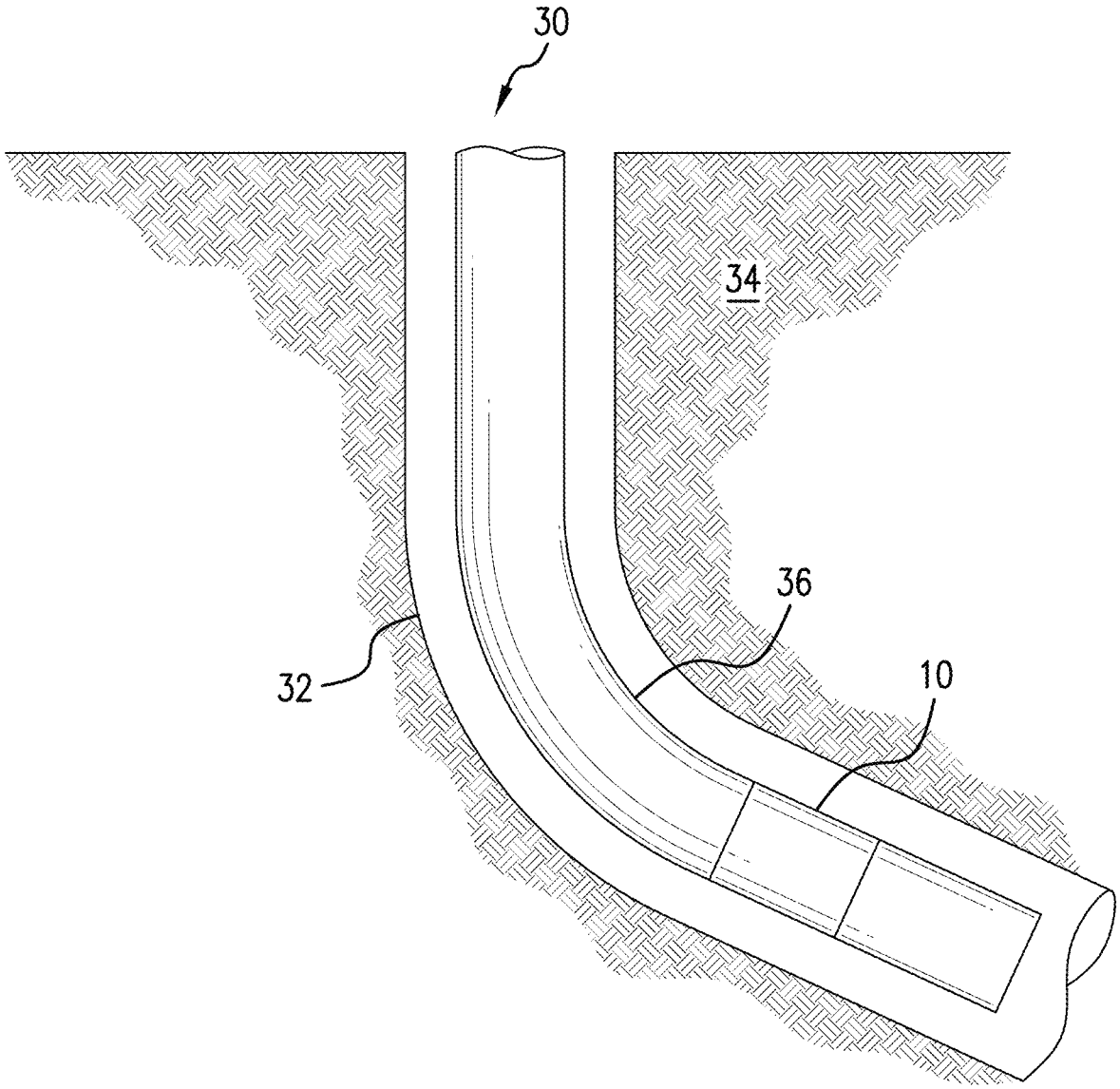
FIG. 6 is a view of a borehole system including a whipstock assembly having an anchor and debris management device as disclosed herein.

Referring to FIG. 6, a borehole system 30 is illustrated. The system 30 comprises a borehole 32 in a subsurface formation 34. A string 36 is disposed within the borehole 30. A whipstock assembly 10 as disclosed herein is disposed within or as a part of the string 36.

Set forth below are some embodiments of the foregoing disclosure:

Embodiment 1: A method for identifying a bad mill track, including running a whipstock assembly, including a whipstock, an anchor attached to the whipstock and a debris management device attached to the whipstock, the device including a tracer, to a kick-off point in a borehole, running a mill along the whipstock and monitoring a cuttings stream for presence of the tracer.

Embodiment 2: The method as in any prior embodiment, wherein the monitoring includes applying a light source to the cuttings stream.

Embodiment 3: The method as in any prior embodiment, wherein the light source includes ultraviolet light or black light.

Embodiment 4: The method as in any prior embodiment, wherein the tracer is florescent.

Embodiment 5: The method as in any prior embodiment, wherein in the event the mill follows a bad track and mills the debris management device the method includes releasing the tracer by the milling of the debris management device and identifying the tracer at a remote location.

Embodiment 6: The method as in any prior embodiment, wherein the remote location is a surface location.

Embodiment 7: The method as in any prior embodiment, wherein the tracer is dispersed in the debris management device.

Embodiment 8: The method as in any prior embodiment, wherein the tracer is disposed in a recess of the debris management device.

Embodiment 9: A whipstock assembly including a whipstock, an anchor attached to the whipstock, a debris management device attached to the anchor, the device inhibiting the migration of debris from a mill during use from migrating downhole of the anchor, and a tracer disposed in contact with the debris management device, the tracer configured for release from the device in the event the device is damaged.

Embodiment 10: The assembly as in any prior embodiment, wherein the debris management device comprises a material and the tracer comprises a material, the material to the tracer and the material of the device being mixed.

Embodiment 11: The assembly as in any prior embodiment, wherein the tracer is disposed in a recess of the debris management device.

Embodiment 12: The assembly as in any prior embodiment, wherein the tracer is human-eye visibly distinct from cuttings.

Embodiment 13: The assembly as in any prior embodiment, wherein the tracer is a fluorescent material.

Embodiment 14: A borehole system, including a borehole in a subsurface formation, a string in the borehole, and a whipstock assembly as in any prior embodiment disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of +8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method for identifying a bad mill track, comprising:

running a whipstock assembly, including a whipstock, an anchor attached to the whipstock and a debris management device attached to the whipstock and configured to catch rather than drop debris created by a mill run against the whipstock, the device including a tracer, to a kick-off point in a borehole;

running a mill along the whipstock catching debris with the debris management device, the debris management device comprising a material and the tracer comprising a material, the material of the tracer and the material of the device being mixed at a manufacturing stage of the whipstock assembly; and monitoring a cuttings stream for presence of the tracer.

2. The method as claimed in claim 1, wherein the monitoring includes applying a light source to the cuttings stream.

3. The method as claimed in claim 2, wherein the light source includes ultraviolet light or black light.

4. The method as claimed in claim 1, wherein the tracer is florescent.

5. The method as claimed in claim 1, wherein in the event the mill follows a bad track and mills the debris management device the method includes releasing the tracer by the milling of the debris management device and identifying the tracer at a remote location.

6. The method as claimed in claim 5, wherein the remote location is a surface location.

7. A whipstock assembly comprising:

a whipstock;

an anchor attached to the whipstock;

a debris management device attached to the anchor and extending radially outwardly from the anchor, the device inhibiting the migration of debris from a mill during use from migrating downhole of the anchor; and a tracer disposed in contact with the debris management device, the tracer configured for release from the device in the event the device is damaged, wherein the debris management device comprises a material and the tracer comprises a material, the material of the tracer and the material of the device being mixed at a manufacturing stage of the whipstock assembly.

8. The assembly as claimed in claim 7, wherein the tracer is human-eye visibly distinct from cuttings.

9. The assembly as claimed in claim 7, wherein the tracer is a fluorescent material.

10. A borehole system, comprising:

a borehole in a subsurface formation;

a string in the borehole; and a whipstock assembly as claimed in claim 7 disposed within or as a part of the string.

* * * * *